United States Patent [19]

Taylor

[11] 4,185,865

[45] Jan. 29, 1980

[54] RELEASABLE WIRELINE OVERSHOT

[76] Inventor: William T. Taylor, P.O. Box 309 (Rte. 2, Box 291A), Warren, Tex. 77664

[21] Appl. No.: 887,347

[22] Filed: Mar. 16, 1978

Related U.S. Application Data

[63] Continuation of Ser. No. 583,773, Jun. 4, 1975.

[51] Int. Cl.[2] ..... E21B 31/02

[52] U.S. Cl. ..... 294/86.3; 294/86.18

[58] Field of Search ..... 294/86.3, 86.25, 86, 294/96, 86.1, 86 A, 86.17–86.19, 86.2, 86.26, 86.29, 86.31, 86.33; 166/88, 89, 99; 175/315

[56] References Cited

U.S. PATENT DOCUMENTS

| | | | |
|---|---|---|---|
| 2,745,693 | 5/1956 | McGill | 294/86.18 |
| 2,893,491 | 7/1959 | Crowe | 175/315 |
| 3,628,822 | 12/1971 | Bostack | 294/86.18 |

*Primary Examiner*—James B. Marbert

*Attorney, Agent, or Firm*—Guy E. Matthews

[57] ABSTRACT

An overshot adapted to engage and disengage a fishing neck in a well bore. The apparatus comprises an overshot body, a set of collet fingers which deflect radially and have a surface to grasp a fish in a well bore, a tapered surface abutting the collet fingers which deflect inwardly and outwardly to engage and disengage the fish, and a cam and cam follower mechanism. The cam preferably includes a set of inwardly projecting pins which engage grooves formed on a cam body. The grooves cause the cam body to move upwardly and downwardly with respect to the overshot body. The cam body reciprocates, moving the fingers relative to the tapered surface, thereby providing the engagement and disengagement movement. The cam body causes repetitive movement lengthwise of the cam body relative to the pins which serve as a cam. The groove enables movement toward one end of the body and then toward the other. A spring forces the cam body in one direction while it is forced in the other direction by contact with the fish. Movement in the two directions is typically achieved by jarring to set the tool and jarring to release the tool. A wash pipe through the tool is optionally included.

11 Claims, 7 Drawing Figures

RELEASABLE WIRELINE OVERSHOT

This is a continuation of application Ser. No. 583,773, filed June 4, 1975.

BACKGROUND OF THE INVENTION

Overshots are available in the oilfield service industry. Overshots are described in the composite catalog at Pages 654 et seq. Some of the overshots shown are able to grasp a fish and lift it. However, they typically are limited in release operations. One common releasing and circulating overshot is released only by jarring down heavily and rotating simultaneously to the right. This limits the running of such a tool to a tubing string. It is inconvenient to assemble a tubing string and particularly snub it into a high pressure well to provide service to a down-hole tool. This is merely representative of overshots known in the past which are limited in that they can be run readily on a tubing string or wireline to engage a fish. However, they generally cannot be easily released without partly destroying the tool or requiring a tubing string for rotation to the right. Tools of the prior art are believed deficient in providing an overshot which can be run on a wireline and be releasable without destroying the tool.

Some overshots are released by heavy jarring which shears a pin or the like. Such jarring is so forceful that it is likely to damage down-hole equipment. Survey instruments sometimes must be fished from the hole, and an overshot can be used to grasp the instrument for retrieval. If it is hung and a heavier overshot must be used, heavy jarring is required to free the overshot from the survey instrument. Survey instruments are formed of small, delicate instrumentation and can easily be damaged by jarring. It is inconvenient and difficult to use rotation to release overshots because they require a tubing string to transmit torque, while a wireline is much cheaper to run.

The present invention is a releasable wireline overshot which releases on an up and down reciprocating motion and not on rotation or heavy jarring. This enables it to be run on a wireline which is far more convenient than a tubing string.

SUMMARY OF THE INVENTION

The present invention is directed to multiple embodiments of an overshot. The overshot is adapted to be run conveniently on a wireline, or if desired, can include a wash pipe enabling circulation through it on a wireline or connected at the lower end of a tubing string for circulation purposes. It incorporates an overshot body which supports a set of collet fingers. The collet fingers carry serrations which grasp a fish. The collet fingers are arranged with a tubular member concentric thereof. The tubular member has a facing tapered surface which deflects the collet fingers inwardly and outwardly on axial movement of the tubular member. The serrations or threads take a bite in the fish and engage it when forced radially toward the fish. They release by spring deflection when the tapered surface is moved.

The overshot body supports a cam which has the form of inwardly directed pins, preferably two, arranged diametrically opposite of one another. The two pins engage a cam body which has a facing groove. The cam body is forced upwardly and downwardly and rotates controlled by the engagement of the grooves with the pin. Movement to one extreme is coupled to the collet fingers and tapered surface to provide a fish catching mechanism while movement of the cam body to the opposite extreme releases the collet fingers. The cam body is grooved preferably fully about its periphery. The groove has a pair of vertical extensions which extend to the upper end, enabling assembly. The groove is shaped to deflect the pin upon axial movement of the cam body, causing the pin moves from a first position to rebound off an opposing shoulder of the groove. The rebound directs the pin toward a facing shoulder which prevents return of the pin to its beginning position and holds it at a second position. The pin then travels in the groove by moving from the second position in a controlled direction along the groove against a facing shoulder, and rebounds toward the opposing shoulder which blocks the pin against return to its second position in the groove. This movement is repetitive. The fully encircling groove is in actuality a duplicate set of equipment and controls movement of the pins from a first position or location to a second and back to the first. This rotates the cam body preferably through 180°. It represents a cycle of operation from released to engaged to released, referring to the operation of the collet fingers. Movement of the cam body is a result of urging by a spring compressed in the tool which bears on the cam body and an opposing force from a bumper sub which is contacted by the fish.

DESCRIPTION OF THE PREFERRED EMBODIMENTS

Figure 1A:
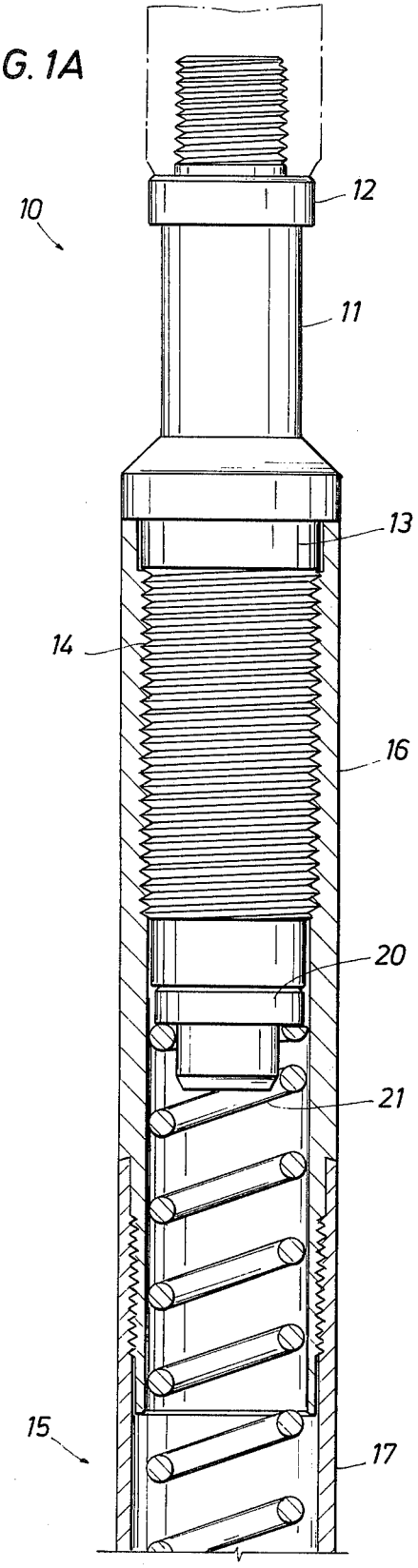
FIGS. 1A and 1B jointly disclose the releasable wireline overshot shown in a section along the diameter of the tool.
Figure 1B:
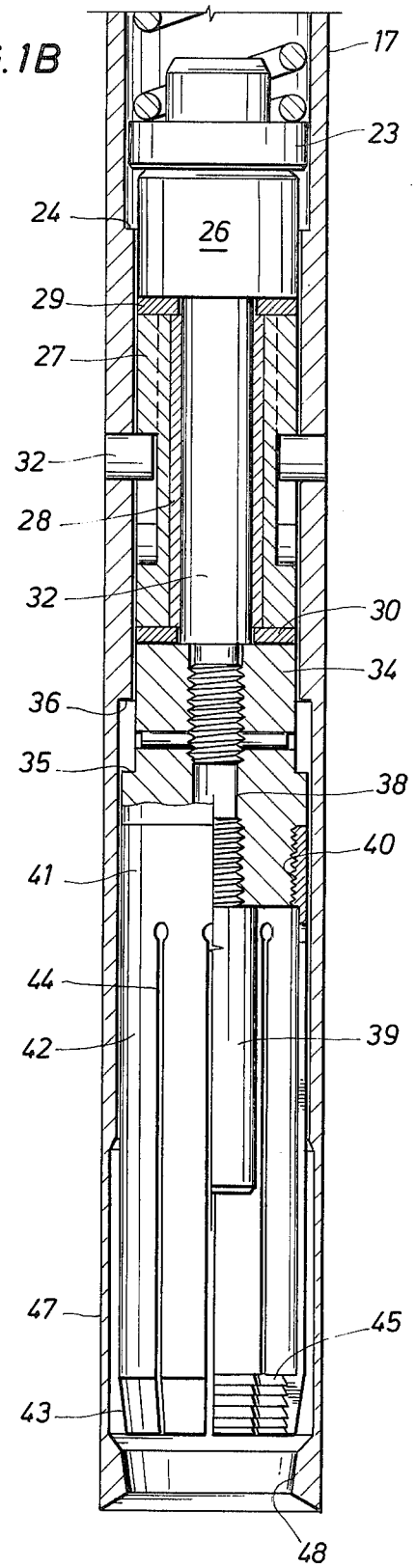

Attention is first directed to FIG. 1 where the releasable wireline overshot 10 is shown. The overshot 10 will be described proceeding from top to bottom of FIGS. 1A and 1B, considered jointly. The top end of the tool incorporates an upper sub 11 which has a fishing neck 12. The upper sub 11 has a narrow neck beneath the enlarged shoulder 12. It extends downwardly to an elongate cylindrical portion 13. It is threaded on the exterior at 14. The threads enable it to connect on the interior of an overshot body 15. The body 15 can be formed of one piece. However, it is more convenient to fabricate it of multiple pieces. The overshot body 15 incorporates an upper threaded member 16 which threads to the upper sub 11. The section 16 also threads at its lower end to an additional section 17 which continues the overshot body 15.

A spring washer 20 abuts the lower end of the top sub 11. It is captured on the interior of the overshot body 15. It supports a coiled spring 21 on a shoulder. It extends axially of an internal cavity within the overshot body 15. It bears against a lower washer 23 and has an upwardly facing shoulder and a centering pin to capture the spring on the shoulder. The spring forces the washer 23 downwardly.

The tubular member 17 includes an internal shoulder 24 which limits downward travel of the washer 23 at the urging of the spring 21. The washer 23 transmits a force against a cylindrical tubular member 26. The cylindrical member 26 abuts a cam body 27 which is cylindrical and hollow, preferably fitting about a hollow tubular member 28. The cam body 27 rotates around the tubular member 28 and is captured at its upper end by a thrust washer 29 and a similar thrust washer 30 at the lower end. The cam body 27 is slightly smaller than the surrounding tubular member 17 and is free to rotate. Rotation is controlled or guided by a protruding lug or pin 32. Only one pin is required, but preferably two are included for symmetry. The pins are identical, and are preferably located diametrically opposite one another and protrude inwardly. They fit into grooves or slots cut on the exterior of the cam body 27. The shape of the cam (the groove) will be discussed hereinafter.

The cam body 27 rotates and moves vertically. As it moves vertically, it moves between upper and lower limits of travel. Its travel is communicated to the tubular member 28 which is hollow and receives a concentric elongate member 32 which threads into a cylindrical member 34. The cylindrical member 34 has an enlarged shoulder 35 which faces upwardly and abuts against a shoulder 36 formed on the interior of the overshot body 15. The two shoulders cooperate to limit upward travel of the apparatus on the interior of the overshot body 15. This limit on upward travel is similar to the limit on downward travel engendered by the internal shoulder 24 shown at the upper portions of FIG. 1B.

The body 34 is axially drilled at 38. It is tapped with threads to enable the member 32 to thread into it at the upper end of the axial passage. A bumper sub 39 is threaded into the lower portions of the passage 38. The bumper sub 39 extends beyond and below the body 34. The bumper sub 39 is threaded to and extends below the body 34 and serves to communicate an axial push from a fish. The bumper sub 39 is smaller in diameter and extends below the body 34. The body 34 has threads 40 on its exterior which support an encircling collar 41 which threads on the threads and supports a number of fingers 42. The fingers 42 are cut in the stock of which the collar 41 is an integral part, and they define a number of flexible collet fingers. The fingers 42 are elongate, ending at a slightly inwardly tapered surface 43. The fingers 42 are separated by elongate slots 44 cut in the stock. The slots end at a stress-relieving circular hole.

On the interior of the fingers, a set of serrations 45 is defined. The serrations face inwardly and upwardly and collectively grip a fish and take a bite into the fish when the collet fingers are forced against it. The serrations 45 are able to grip and hold a fish. They move radially inwardly and outwardly with the fingers 42 which act as springs deflecting in a controlled manner.

The collet fingers 42 are fixed relative to the bumper sub 39 which defines the depth to which a fish penetrates the set of collet fingers. It is possible for the tool to swallow more of the fish, but it is not necessary. Only shallow penetration is required.

The body 34, collar 41, collet fingers 42, and bumper sub 39 all move upwardly and downwardly as a unit on the interior of the tubular member 17. The lower portions of the tubular member 17 are identified at 47. This defines a surrounding surface about the collet fingers 42. The tubular member 17 incorporates an inwardly directed tapered surface 48 which is adjacent to the lower end 43 of the collet fingers. The surface 48 cooperates with the collet fingers to deflect the tips inwardly and outwardly. The lower end of the tubular member 17 provides a tapered surface which deflects the fingers inwardly and outwardly. When they deflect outwardly, they release or disengage a fish. When they deflect inwardly, the serrations collectively define a gripping surface which grabs and holds the fish. The deflection inwardly and outwardly is determined by axial movement of the equipment on the interior of the tubular member 17. This is controlled by the cam to be described hereinafter.

Figure 3:
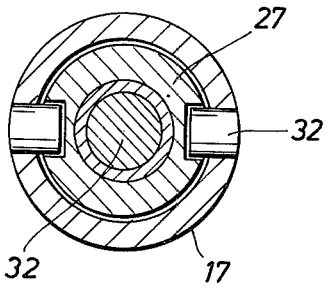
FIG. 3 is a sectional view along the line 3—3 of FIG. 2 showing an arrangement of pins which serve as cams in extending into grooves formed on a cam body.

FIG. 3 shows the pins 32 extending into grooves formed in the cam body 47. The tubular member 17 supports the pins so that the cam body 27 is guided dependent on axial and rotational movement for its operation under control of the pins. The pins serve as a cam follower mechanism.

Figure 2:
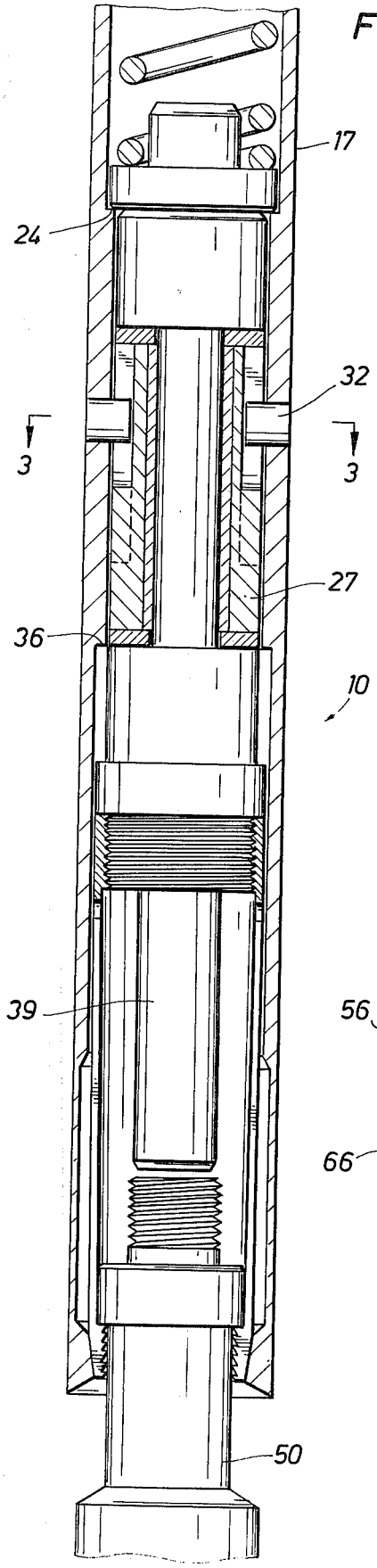
FIG. 2 is a view similar to FIG. 1B showing a fish engaged by the tool and particularly illustrating the cam body moved relatively downwardly relative to the pins which align it.

In FIG. 2, all of the apparatus remains the same as shown in FIGS. 1A and 1B. However, the movable components on the interior of the tubular body 17 are moved relatively downward in grasping a fish 50. The exemplary fish has a standard API fishing neck on it and is stabbed into the interior space toward abutment against the bumper sub 39. The bumper sub 39 is pushed axially relative to the hollow body 17. In the sequence of operation, the overshot 10 is forced over the fish 50 by its own weight which is optionally enhanced by weight bars. The fish 50 stabs internally of the collet fingers and contacts the bumper sub 39. The bumper sub 39 is forced upwardly against the force of the spring. When it moves upwardly, the cam body 27 moves in a manner to be described, permitting its upward movement toward a top-most position. The top-most position compresses the spring and the spring subsequently forces the movable parts downwardly. When they move downwardly, the cam body 27 rotates and assumes a new relationship to the pin 32. This downward and rotative movement causes relative axial movement of the external hollow body 17. FIG. 2 should be contrasted with FIG. 1B. It shows the collet fingers forced downwardly and inwardly. The tubular member 17 moves relatively upwardly to engage the collet fingers to force them inwardly toward a gripping position. Gripping of the fish is achieved in FIG. 2. The collet fingers are jammed inwardly against the fish 50 to grip and hold it firmly. When they hold it, they prevent the fish from escaping the grip of the overshot 10. This is achieved on relative downward movement of the collet fingers under control of the cam and cam follower mechanism.

Figure 4:
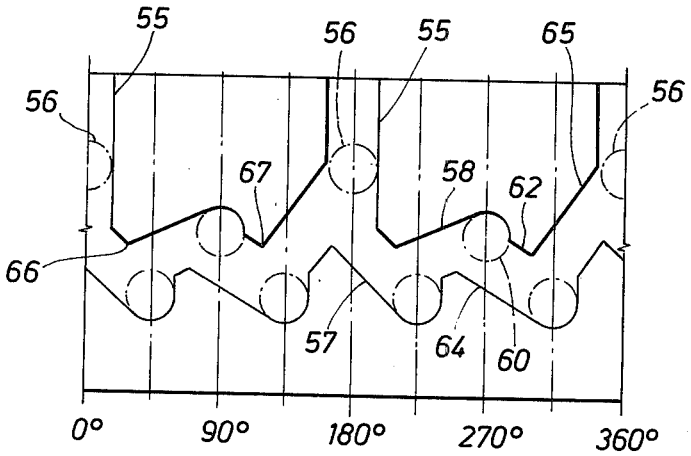
FIG. 4 shows the exterior of the cam body which is formed with a groove extending fully about the cam body and showing the groove construction in the full 360° development thereof; and, FIGS. 5A and 5B jointly disclose an alternative embodiment of the present invention, including a wash pipe extending therethrough to enable circulation through it the tool if desired.

FIG. 4 shows the way the cam and cam body are constructed. The groove means formed on the exterior surface of the cam body 27 is shown planar representing the circular surface as a rectangle. The degree markings of FIG. 4 locate the groove which is cut in the cam body. The groove is repeated in two segments of 180° each. The two pins cooperate with the two identical segments of the groove. This is the preferred construction. A description of operation will focus on the path of only one pin, the second pin moving in a similar fashion in the duplicate segment of the groove.

The lengthwise groove 55 receives the pin 32 during assembly. Thereafter, the pin does not travel to the extremity or upper end of the groove 55. The groove 55 provides a resting place or first position for the pin at 56. This is approximately where the pin rests when the cam body 27 is moved as low as possible in the overshot body 15, and this is the position of FIG. 2. Movement of the pin from the position 56 is relatively downwardly and against the facing angled shoulder or wall 57. When this occurs, the cam body is rotated by the fixed pin and the spring 21 causes the pin to rebound, relatively speaking, off the facing wall 57 and directs it toward a facing angled wall 58. The opposing wall 58 prevents the pin from returning toward the groove portion 55. The pin is then captured in the V-shaped portion of the groove defined by the walls or shoulders 58 and 62. The pin then comes to rest at a second position indicated in dotted line at 60. This is the other extremity of movement of the cam body. This is achieved when the equipment within the overshot body 15 slides upwardly until it is limited by the shoulder 36. The limit on travel of the shoulder 36 causes the rebound of the pin from the facing wall 57 whereupon the pin relatively travels upwardly in the grooves but encounters the angled wall 58 which deflects it to the second position. This is where it comes to rest to achieve the position of FIG. 1B. The first and second positions are stable and hold the parts indefinitely. The transition from the first to the second position represents a shift from the fish engaging position of FIG. 2 to the fish releasing position of FIG. 1B.

Transition from the second position back to the first is achieved in similar manner. The pin travels vertically from the second position 60 and is deflected at an angle by the opposing surface or shoulder 64. This deflects the pin to the right as viewed in FIG. 4, and the limit on vertical movement is reached whereupon the spring force carries the pin relatively toward the surface 65. The surface or shoulders 62 and 65 define a protruding point which prevents the pin from returning to the position 60. It travels from the second position to contact the shoulder 64 and deflects toward the shoulder 65, and is guided by that shoulder to the first position 56 again. It will be noted that the straight portion 55 is duplicated at two locations. They are diametrically opposite. The grooves which extend around the cam body 47 are duplicated. Rotation of the cam body 180° completes one cycle of operation in operating the overshot from a fish disengaged position to an engaged position and back to the disengaged position, or in the opposite sequence. The arrangement of the groove means on the exterior of the cam body 27 transmits the described motion to body pins which are diametrically opposite one another.

The facing shoulders which define the groove mechanism are equipped with strategically located corners 66 and 67 which force the pin to "turn the corner" in the guided path and prevent return of the pin toward the beginning position.

In operation, the tool is run into a tubing string on a wireline equipped with a set of jars. When it engages a fish, the fish is pushed into the collet fingers which are retracted as shown in FIG. 1B. The fish pushes upwardly and contacts the bumper sub 39. This forces the bumper sub upwardly and the camming action occurs. The camming action begins with the pin originally in the release position 60. The bumper sub 39 and the movable equipment on the interior of the tool slide axially. The cam body 27 rotates simultaneously. In FIG. 2, the movable internal parts slide upwardly while the camming action enables movement of the pin from the position 60 and its transition to the bottom line position 56. The spring 21 forces the cam and the slidable parts downwardly through the limits of travel defined by the shoulder 24. When this occurs, the collet fingers are jammed against the surrounding internal tapered surface 48 and are deflected inwardly to take a bite on the fish. This grasps or engages the fish. Release is achieved in the same manner, by jarring downwardly on the tool which causes the camming action and results in positioning the collet fingers as shown in FIG. 1B where they are spaced from the surrounding tapered surface which are free to deflect outwardly, permitting disengagement of the fish.

The apparatus engages and disengages a fish by simple jarring action.

Figure 5A:
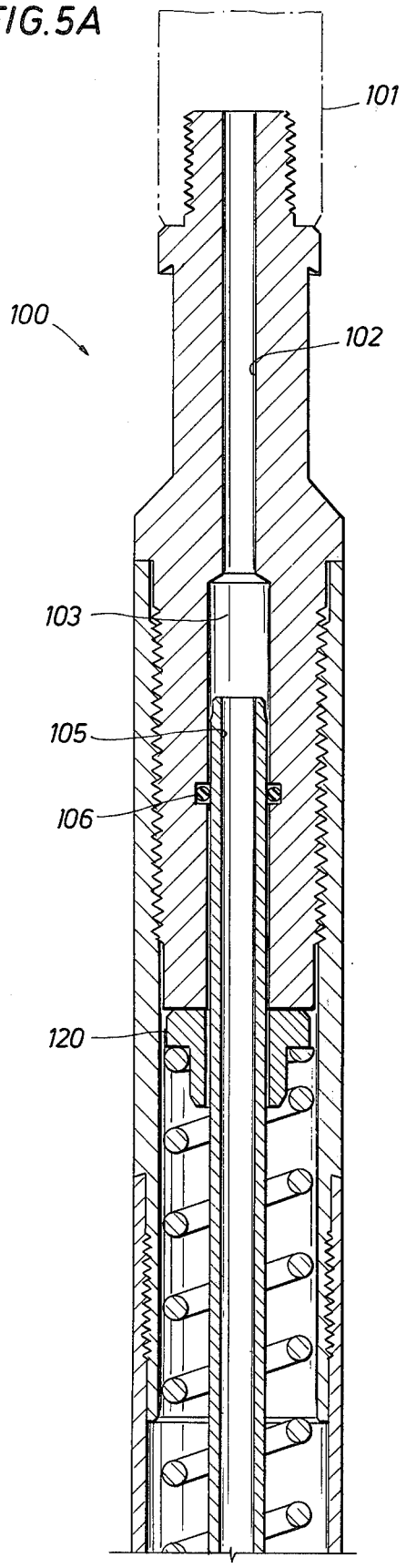
Figure 5B:
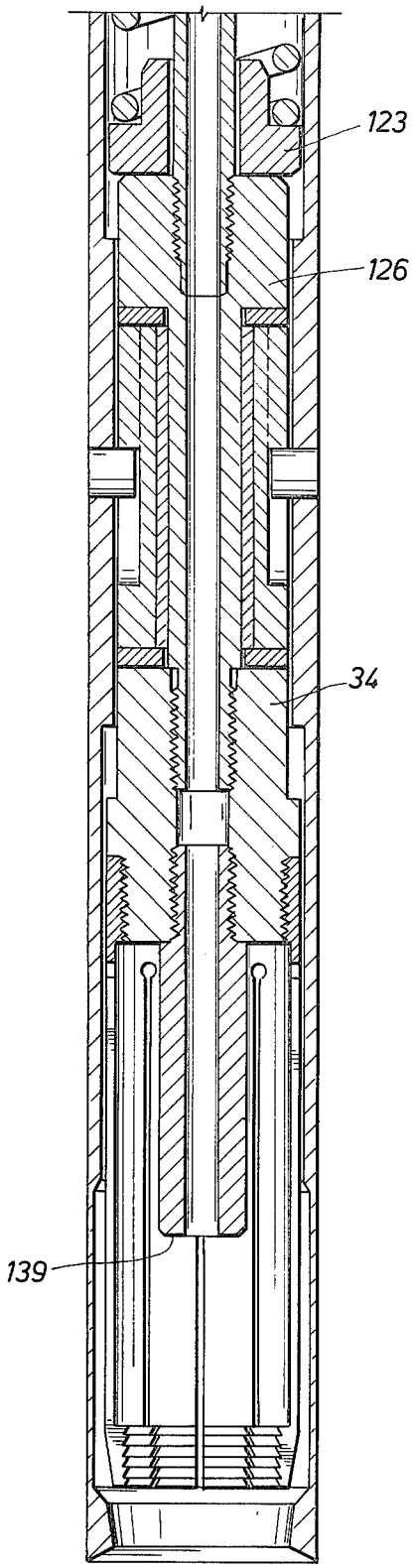

FIGS. 5A and 5B show an alternative embodiment 100. It differs in that it provides a wash pipe through the apparatus. Ordinarily the embodiment 10 is run on a wireline. The embodiment 100 can be run on a tubing string. A connector 101 which provides fluid flow from a tubing string is shown. The apparatus is similar in construction to the embodiment 10, and this description will be directed to the path through the equipment which incorporates the wash pipe. The upper end of the tubing includes the passage 102. It extends downwardly to an enlarged passage 103. The passages 102 and 103 are formed in the upper sub described in the embodiment 10. The washer 20 is duplicated, but is drilled axially with a passage. The washer 120 is adapted to receive a hollow tubular member 105 in it. The wash pipe 105 is sealed by a surrounding seal 106. The wash pipe 105 is free to slide vertically with operation of the cam mechanism. The wash pipe 105 extends through the spring down to the lower thrust washer 23 which is modified into a center-drilled washer 123. The solid cylindrical spacer member 126 is drilled and is internally threaded to engage the wash pipe 105. It is drilled axially all the way to the bottom and threads to the tubular member 34. The bumper sub 39 is drilled axially and is the element 139. This completes the passage through the tool and enables the tool to be used to grasp a fish, for instance, which is surrounded by sand and enable fluid to be pumped through a tubing string and through the overshot 100 to wash away the sand. It is also useful in washing away cuttings from a milling operation or the like. If circulation can be maintained through the tool, and the apparatus 100 enables this, certain down-hole remedial steps can be more easily accomplished.

In operation, the embodiment 100 functions identically to the embodiment 10. It sets and releases in the same manner. The only difference is the provision of the axial passage through the tool to enable circulation to be maintained through it.

I claim:

1. An overshot operable on a wire line, comprising:

(a) an overshot body;

(b) a first means carried on said body, said first means functioning as a cam follower;

(c) an elongate set of collet fingers mounted with a bumper portion supported by said body and arranged in a circular fashion to engage a fish in a well, said fingers flexing to accommodate variations in the size of the fish;

(d) a tapered surface supported by said body adjacent said collet fingers, said tapered surface movable axially relative to said collet fingers which axial movement deflects said collet fingers between fish engaging and disengaging positions;

(e) means for axially urging said collet fingers into fish engaging position; and (f) cam means operably connected to said collet fingers, said cam means defining a serious of inclined surfaces, said cam means engaging said first means, whereby initial relative axial movement of said first means and said cam means operates to rotate said cam means in a single direction relative to said first means, which rotational movement causes said cam means to engage said first means to shift said first means axially relative to said body, which relative axial movement deflects said collet fingers between fish engaging and disengaging positions, such action being effected by repeated axial impacts applied to said bumper portion by said fish against the action of said urging device, to shift said overshot between fish engaging and disengaging positions upon each successive axial impact.

2. The apparatus of claim 1 wherein said first means includes a pin extending interiorally of said body and said body has an axial chamber therein for receiving said cam means which comprises a groove means formed on the exterior of a tubular member movable in said chamber but with its movement constrained by co-action of said pin received in said groove means, which pin and groove means co-action transfers axial movement to said collet fingers relative to said tapered surface to obtain the fish engaging and disengaging positions.

3. The apparatus of claim 2 wherein said cam means includes an endless groove which moves said pin from a first position to a second position and then to the first position all in a sequence of operation which returns the first means to a position from which said first means and cam means move repetitively between engaged and disengaged positions.

4. The apparatus of claim 3 wherein said endless groove moves said pin relatively toward one end of said tubular member and then toward the other end thereof, and including means engaging said tubular member which imparts relative longitudinal movement between said collet fingers and said tapered surface.

5. The apparatus of claim 1 wherein said tool includes a surface for contacting a fish, said surface being encircled by said collet fingers which extend beyond said surface and are adapted to encircle the fish;

second means connected from said surface to said cam means for urging said cam means longitudinally relative to said overshot body which cam means cooperatively moves relative to said first means which movement alters the engagement of said cam means to the second position from the first position;

resilient means for urging one of said collet fingers and tapered surface relatively of the other to alter the deflection of said fingers; and, means for controllably releasing a force from said resilient means on operation of said second means coupled to said cam means, said means forcing said collet fingers to move relative to said tapered surface to alter the engaging position thereof.

6. The apparatus of claim 5 wherein said cam means has a shoulder means which extends to a first location and to a second location which differ from one another and which guide said first means.

7. The apparatus of claim 6 wherein said shoulder means is constructed and arranged to limit said first means at the first location and direct said first means toward the second location which movement limits said first means in a subsequent movement.

8. The apparatus of claim 9 wherein said shoulder means extends toward both ends of an elongate tubular member which functions as said cam means, and said shoulder means has curved portions at the first and second locations which limit said first means in its movement which movement is achieved on relative lengthwise shifting of said tubular member.

9. The apparatus of claim 1 wherein said first means comprises an elongate pin and said cam means comprises a movable body having a cylindrical outer surface and a groove means formed in said outer surface which groove means is engaged by said pin, said groove means being dimensioned to receive said pin therein between a pair of facing side walls and wherein said groove means extends toward the upper and lower ends of said overshot body at different portions thereof such that said pin forces said movable body toward the upper and the lower ends of said overshot body at different portions thereof such that said pin forces said movable body toward the upper and the lower ends of said overshot body which movement is alternately achieved to define the fish engaging and disengaging positions.

10. The apparatus of claim 1 wherein said cam means comprises a cylindrical body having upper and lower ends which define an intervening circular surface which surface has a groove cut therein, said groove gully encircling said cylindrical body and further having groove portions extending toward the upper and lower ends; and said first means comprising a pin which extends radially from said body into said groove; said groove having a pair of facing shoulders which guide said pin along said groove to define first and second positions in said groove for said pin which positions move said collet fingers and said tapered surface axially of one another.

11. The apparatus of claim 10 wherein said groove has a first portion extends from one end of said cylindrical body along said body to define a three way intersection, and said groove has two other portions at the intersection, the two other portions intersecting said first portion and the shoulders defining said groove portions being constructed and arranged to direct said pin along only one of the two other portions from said first portion.

* * * * *